US006971188B1

(12) United States Patent
Chesley, III et al.

(10) Patent No.: US 6,971,188 B1
(45) Date of Patent: Dec. 6, 2005

(54) BRINE SHRIMP EGG PROCESSING APPARATUS AND METHOD

(75) Inventors: James Chesley, III, Salt Lake City, UT (US); Samuel Chesley, Salt Lake City, UT (US)

(73) Assignee: North American Brine Shrimp, L.L.C., Salt Lake City, UT (US)

( * ) Notice: Subject to any disclaimer, the term of this patent is extended or adjusted under 35 U.S.C. 154(b) by 0 days.

(21) Appl. No.: 10/996,251

(22) Filed: Nov. 23, 2004

Related U.S. Application Data

(62) Division of application No. 10/356,343, filed on Jan. 31, 2003, now Pat. No. 6,820,351.

(60) Provisional application No. 60/353,516, filed on Jan. 31, 2002.

(51) Int. Cl.[7] ..... F26B 3/08

(52) U.S. Cl. ..... 34/364; 34/370; 34/371; 34/579

(58) Field of Search ..... 34/360, 364, 368, 34/370, 371, 579, 591, 592

(56) References Cited

U.S. PATENT DOCUMENTS

| | | | | |
|---|---|---|---|---|
| 790,162 | A | 5/1905 | Trump | |
| 1,416,922 | A * | 5/1922 | Wood | 209/138 |
| 2,174,897 | A | 10/1939 | Sackett | |
| 2,199,015 | A | 4/1940 | Toensfeldt | |
| 2,330,545 | A * | 9/1943 | Benoit | 34/591 |
| 2,361,940 | A * | 11/1944 | Hall | 159/4.1 |
| 2,550,374 | A * | 4/1951 | Palmer | 208/153 |
| 2,912,768 | A | 11/1959 | Huston et al. | |
| 3,360,870 | A | 1/1968 | Stephanoff | |
| 3,646,688 | A | 3/1972 | Osterman | |
| 4,070,765 | A | 1/1978 | Hovmand et al. | |
| 4,163,064 | A | 7/1979 | Hill | |
| 4,534,282 | A * | 8/1985 | Marinoza | 99/451 |
| 4,814,868 | A | 3/1989 | James | |
| 4,996,780 | A | 3/1991 | Soul-Sun Goe | |
| 5,088,210 | A | 2/1992 | Goe | |
| 5,152,079 | A | 10/1992 | Goe | |
| 5,307,567 | A | 5/1994 | Schnake et al. | |
| 5,345,693 | A | 9/1994 | Skjold | |
| 5,632,097 | A | 5/1997 | Snitchler et al. | |
| 5,707,594 | A * | 1/1998 | Austin | 422/186.3 |
| 5,718,623 | A | 2/1998 | Wilson et al. | |
| 5,894,936 | A | 4/1999 | Sanders et al. | |
| 6,820,351 | B1 | 11/2004 | Chesley, III et al. | |

* cited by examiner

*Primary Examiner*—Cheryl Tyler
*Assistant Examiner*—Kathryn S. O'Malley
(74) *Attorney, Agent, or Firm*—Madson & Metcalf

(57) ABSTRACT

An enhanced apparatus and method for cleaning, drying, and disinfecting brine shrimp eggs is provided. The apparatus may have a blower and a furnace that provide pressurized, dry air to a screening device. The screening device may include a vibrating screen designed to release detritus while retaining viable cysts. The dry air may convey the cysts upward and suspend them within a containment vessel. The containment vessel may have a lower, narrow section and an upper, wide section; the larger airflow velocity within the narrow section suspends the brine shrimp eggs while the remaining detritus moves upward, into the wide section, in which the airflow velocity is lower. The air suspension rapidly dries the cysts to maintain a high percentage of viable eggs. Ultraviolet lights disinfect the cysts within the narrow section. An extractor with a cyclone separator draws material from the wide section and removes viable eggs from the detritus.

16 Claims, 2 Drawing Sheets

BRINE SHRIMP EGG PROCESSING APPARATUS AND METHOD

CROSS REFERENCE TO RELATED APPLICATIONS

This application is a division of U.S. application Ser. No. 10/356,343, filed Jan. 31, 2003, now U.S. Pat. No. 6,820,351, which claims the benefit of U.S. Provisional Application No. 60/353,516 filed Jan. 31, 2002, which are incorporated herein by reference.

BACKGROUND OF THE INVENTION

The present invention relates to systems and methods for processing brine shrimp eggs. More specifically, the present invention relates to an apparatus and method for drying, cleaning, and disinfecting brine shrimp eggs to provide a highly viable end product.

Brine shrimp are a nutritious food source for fish and shrimp larvae. Brine shrimp eggs, or "cysts," are harvested from the surface of a body of water with a high saline content. The eggs can then be dried and stored for lengthy periods of time before hatching; consequently, they can be stockpiled to maintain a population of sea life during times when there is little natural food available.

When harvested, the eggs are invariably gathered together with egg shells, dead brine shrimp, sand, debris, other sea life, and the like. Such material may generally be referred to as "detritus." Additionally, the eggs contain significant quantities of water, which adheres to the outsides of the eggs and is also absorbed by the shells. Hence, the eggs are not only wet, but are also internally saturated with moisture. The water and detritus add significantly to the weight and volume of the brine shrimp eggs.

Furthermore, in the presence of water, the eggs will eventually commence hatching, thereby losing their ability to hatch upon re-hydration. Consequently, the brine shrimp eggs must be dried, internally and externally, and separated from detritus prior to shipping. Additionally, in certain climates, the brine shrimp eggs may tend to carry bacteria that are potentially harmful to the eggs, to the hatched brine shrimp, to the sea life that consumes the brine shrimp, or to the ultimate consumer of the sea life. Thus, it may also be beneficial to disinfect the eggs prior to shipment.

According to known methods, rotating drums, conveyer systems, moving screens, and the like have been used to dry brine shrimp eggs for packaging. Heated air is often blown over the brine shrimp eggs to effect drying. Mechanical devices such as sieves have been used to separate the eggs from detritus.

Unfortunately, such methods are inadequate for a number of reasons. For example, many such methods require an excessive length of time, such as seven or eight hours, to dry and sort a single batch of brine shrimp. The time required tends to cause some of the cysts to begin the hatching process in response to the heat and moisture. Hence, some of the cysts will no longer be viable by the time the drying operation is complete.

In addition, the mechanisms employed often provide a poor separation of the cysts from the accompanying detritus; consequently, the viable content of the final product is further reduced. Additionally, many known methods and devices disinfect the brine shrimp eggs through the use of somewhat destructive chemical methods, such as chlorine rinsing. Other known brine shrimp processing schemes include no disinfecting method, thereby risking exposure of the eggs to harmful bacteria.

Accordingly, a need exists for a brine shrimp egg processing apparatus and method that effectively dries eggs, internally and externally, within a comparatively short time frame. Furthermore, a need exists for an apparatus and method for effectively separating detritus from viable cysts. Yet further, a need exists for an apparatus and method for disinfecting the cysts without subjecting them to potentially damaging chemicals.

SUMMARY OF THE INVENTION

The apparatus and method of the present invention have been developed in response to the present state of the art, and in particular, in response to the problems and needs in the art that have not yet been fully solved by currently available brine shrimp processing systems. Thus, it is an overall objective of the present invention to provide a brine shrimp egg processing apparatus and method that remedies the shortcomings of the prior art. Such an apparatus and method may more rapidly dry the brine shrimp eggs, while using effective and non-destructive methods to disinfect the eggs and separate them from detritus.

To achieve the foregoing objective, and in accordance with the invention as embodied and broadly described herein in the preferred embodiment, an enhanced brine shrimp egg processing apparatus is provided. The processing apparatus may have a blower that provides a flow of pressurized air, a furnace that decreases the relative humidity of the air, a screening device that separates detritus from viable cysts, a containment vessel that forms an air column to support the cysts, and an extractor that removes and sorts the detritus and/or brine shrimp eggs.

The blower may simply receive air from the atmosphere, and may pressurize the air at a desired level. A variable damper, for example, may be used to adjust the pressure and/or flow rate of the air from the blower. The furnace may heat the air to a temperature warm enough to dry the eggs, yet not so warm as to damage the eggs or initiate hatching. The air temperature may be monitored after leaving the furnace through the use of a thermostat; the thermostat may provide feedback control for the furnace to keep the air at the desired temperature.

The air may then enter the screening device, which may have a plenum chamber that receives the air. The air may move upward from the plenum chamber through a vibrating screen with a mesh size just small enough to retain the viable cysts, to reach a separation chamber. Brine shrimp eggs may be carried upward and out of the separation chamber by the air. Detritus, such as shell fragments and the like, may fall through the screen, through the plenum chamber, and into a detritus chamber. Some detritus may also be caught in the airflow with the cysts. A discharge chute may be coupled to the separation chamber to channel viable cysts into a collection container after the apparatus has been deactivated.

The air, with entrained cysts and detritus, moves through a coupling to reach the containment vessel. The containment vessel has a loading chute through which the brine shrimp eggs can be loaded into the apparatus. Furthermore, the containment vessel may have a first section in which the air moves at a comparatively high velocity, and a second section in which the air moves more slowly. In one embodiment, the first section may take the form of a lower, narrow section, and the second section may be an upper, wide section. A flare may be disposed between the two sections. The velocity of the air drops substantially as the air moves through the flare and into the wide section. Hence, the heavier, viable cysts remain within the narrow section, while the lighter detritus is carried into the wide section.

Ultraviolet lights may be included within the narrow section to subject the cysts to ultraviolet radiation. The ultraviolet radiation destroys harmful microbes present on the shells of the cysts. One or more video cameras may be disposed on the wide section and angled so that the field of view of the camera is directed downward, into the collection vessel. Lights may also be used to illuminate the interior of the collection vessel so that the brine shrimp eggs and detritus can be effectively viewed by the camera. The camera may be connected to a display at a remote terminal, from which an operator may monitor and control the apparatus. Other sensors, such as pressure sensors, air velocity sensors, moisture sensors, and the like may additionally or alternatively be used.

The wide section may have a screen at the top, through which air, but not viable cysts, is able to exit the apparatus. Furthermore, the extractor may be coupled to the wide section by a conduit. The extractor may have a blower that draws air and entrained material from the wide section. The extractor may draw the air and entrained material into a receiving chamber, below which a conical chamber is disposed. The conical chamber may act as a cyclone separator, from which heavier particles drop, while lighter particles remain entrained in the airflow. Hence, comparatively heavy, viable cysts may drop into one collection container, while the lighter detritus drops into another.

According to one alternative embodiment, the first and second sections have the same cross sectional area. Again, the second section may be disposed on top of the first section. The airflow velocity differential may be provided by a plurality of vents that permit air to escape from the containment vessel after moving through the first section. The vents may be covered with screens that have a mesh size too small to permit the brine shrimp eggs to escape between the first and second sections. Thus, a smaller flow rate of air moves through the second section, and the velocity of the air is lower in the second section than in the first section. Consequently, as with the previous embodiment, brine shrimp eggs are concentrated within the first section, while detritus tends to rise into the second section.

Through the use of the brine shrimp processing apparatus and method of the present invention, brine shrimp eggs may be gently and rapidly dried through entrainment in an airflow. Furthermore, the brine shrimp eggs may be effectively separated from impurities such as shell fragments, sand particles, and other detritus. The brine shrimp eggs may also be disinfected in a nondestructive, complete manner to protect them against harmful bacteria.

These and other features and advantages of the present invention will become more fully apparent from the following description and appended claims, or may be learned by the practice of the invention as set forth hereinafter.

BRIEF DESCRIPTION OF THE DRAWINGS

A more particular description of the invention briefly described above will be rendered by reference to specific embodiments thereof which are illustrated in the appended drawings. These drawings depict only typical embodiments of the invention and are not therefore to be considered to be limiting of its scope. The invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 and 2, is not intended to limit the scope of the invention, as claimed, but is merely representative of presently preferred embodiments of the invention.

Figure 1:
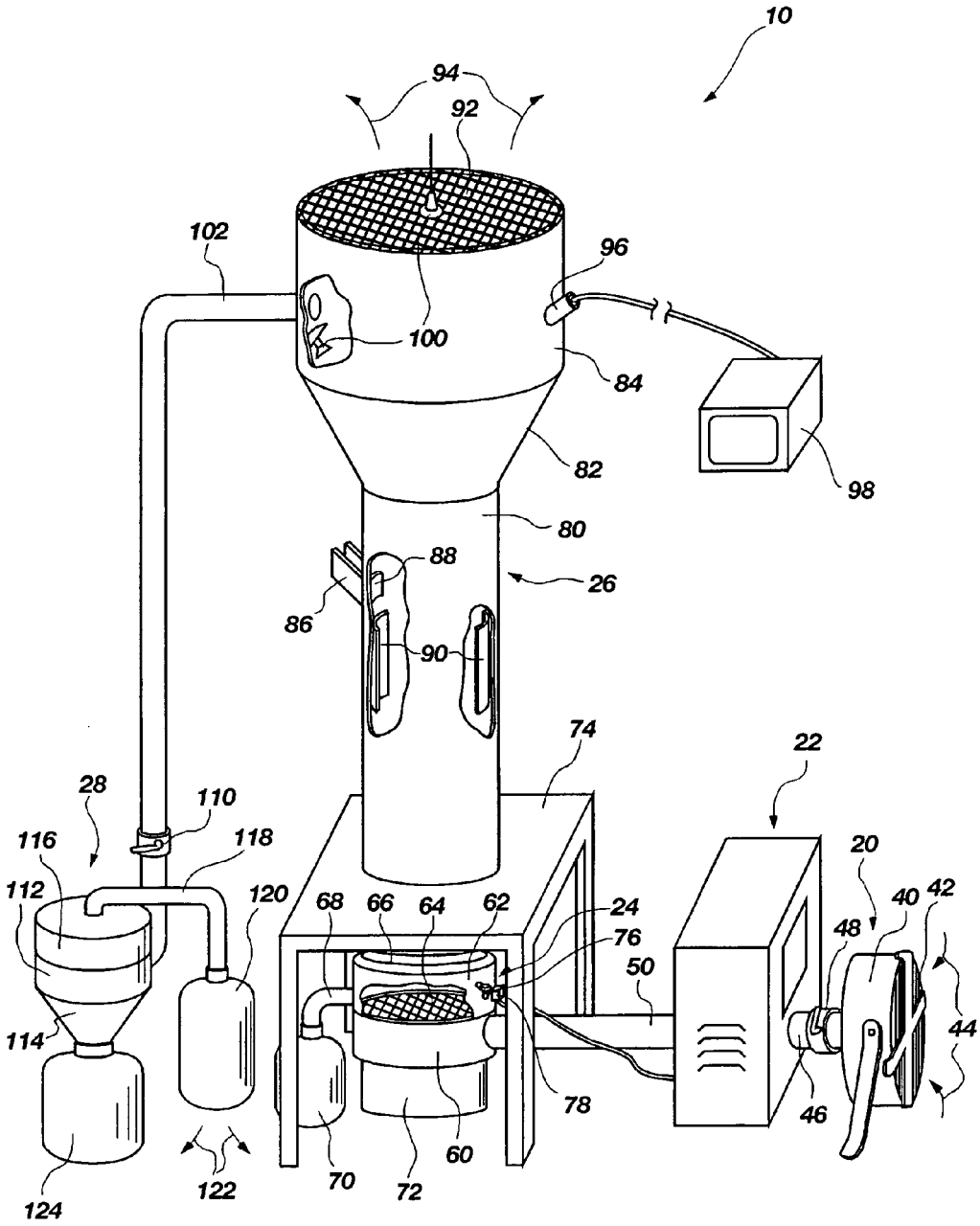
FIG. 1 is a perspective view of one embodiment of a brine shrimp egg processing apparatus within the scope of the present invention.
Figure 2:
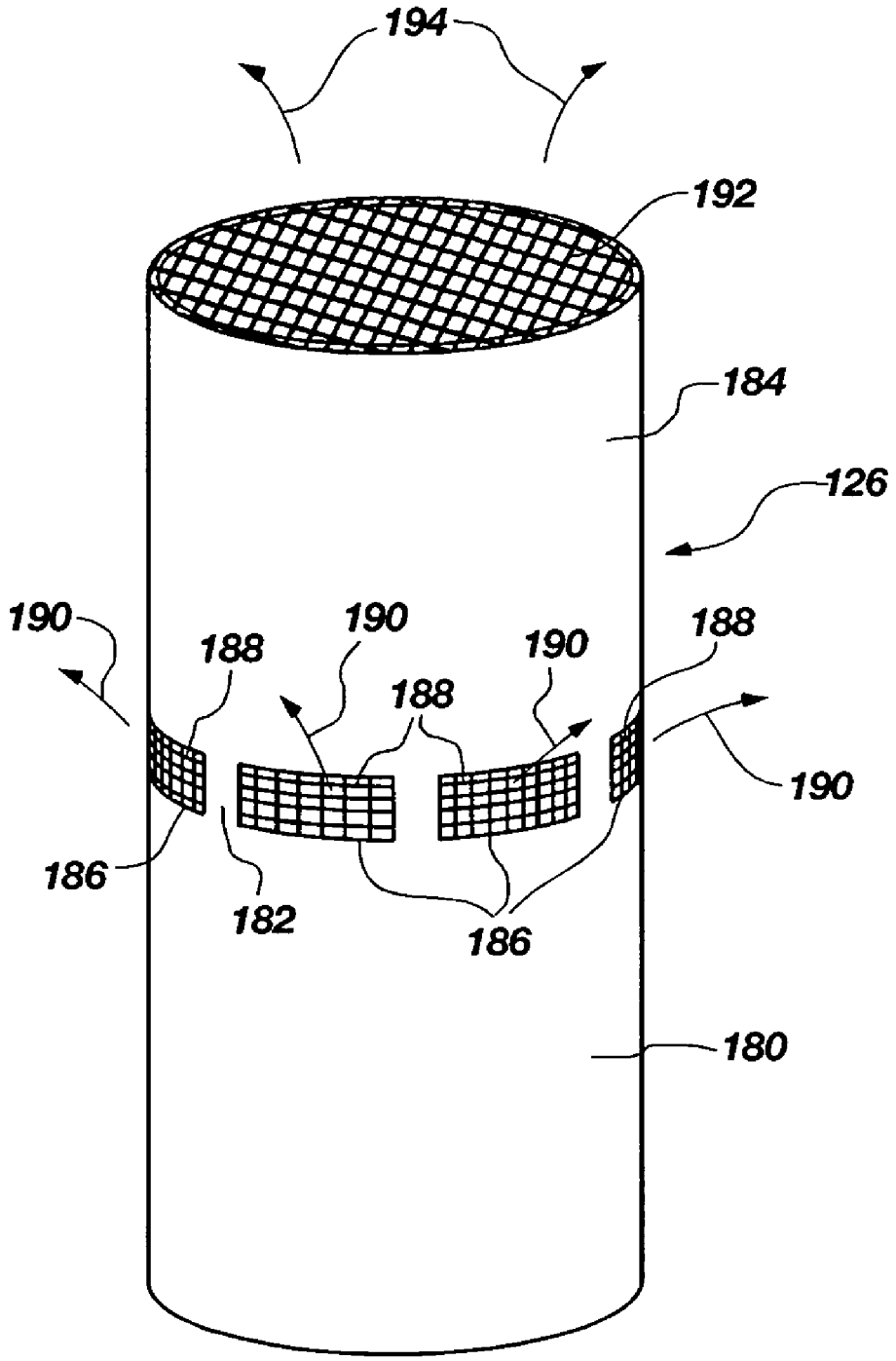
FIG. 2 is a perspective view of one alternative embodiment of a containment vessel that may be as part of a brine shrimp egg processing apparatus within the scope of the invention.

Referring to FIG. 1, one embodiment of a processing apparatus 10 for brine shrimp eggs is depicted. The apparatus 10 may be used to dry, clean, and disinfect brine shrimp eggs that have been gathered and stored for a length of time known to those of skill in the art. The operation of the various components of the apparatus 10 will first be described in general terms, after which more specific descriptions will be provided.

The apparatus 10 may include a blower 20, a furnace 22, a screening device 24, a containment vessel 26, and an extractor 28. The blower 20 may continuously pressurize air to create a stream of moving air, or an "airflow," which is dried by the furnace 22. The dry airflow may be conveyed to the screening device 24, which retains viable brine shrimp eggs while allowing small detritus, such as shell fragments, to drop from the eggs. The dry airflow may convey the brine shrimp eggs and any remaining detritus into the containment vessel 26, in which the eggs and detritus are suspended, dried, and separated by the dry air. The detritus may be drawn from the containment vessel 26 into the extractor 28, which sorts the detritus and/or viable cysts.

The blower 20 may have a housing 40 that contains a motor that drives an air moving element, such as a radial fan (not shown). Of course, any type of device that generates an airflow may be used to form the blower 20; such a device may include a motor of any known type coupled to any known type of air moving element. The blower 20 may simply receive ambient air from an air intake 42; air inflows 44 into the air intake 42 are indicated by arrows. The air may be delivered to the furnace 22 by a conduit 46.

A variable damper 48 may be disposed on the conduit 46 to selectively vary the mass flow rate and/or pressure of air delivered by the blower 20. The variable damper 48 may simply provide a variable flow restriction so that the airflow through the conduit 46 can be effectively metered. The blower 20 may have a mass flow rate of about 4,500 cubic feet per minute; the damper 48 may be used to decrease the mass flow rate to the desired level. The damper 48 may be adjusted continuously throughout the drying, cleaning, and disinfecting process to adapt the flow rate and air pressure to the condition of the brine shrimp eggs within the containment vessel 26. A damper (not shown) may alternatively be integrated with the blower 20. As another alternative, the blower 20 may simply have a variable speed motor.

The furnace 22 may take the form of a duct furnace that uses natural gas or another suitable combustible material. Of course, other devices besides a duct furnace, such as resistance heaters, induction heaters, and the like, may alternatively or additionally be used to heat air to lower its relative humidity. Heating the airflow will decrease its relative humidity because, although moisture is not necessarily removed from the air, the capacity of the air to retain water has been increased.

The furnace 22 receives the airflow from the conduit 46 and heats the air to decrease its relative humidity, so that the air is able to absorb additional moisture from the brine shrimp eggs. Brine shrimp egg processing normally occurs during the winter because the ambient air entering the furnace 22 is cold and dry. If the furnace 22 can produce a larger temperature rise, a greater decrease in relative humidity will result. Hence, air with a higher temperature and a lower relative humidity is conveyed from the furnace 22 to the screening device 24.

The screening device 24 may have a plenum chamber 60, into which the relatively dry air is conveyed by the conduit 50. A separation chamber 62 is disposed above the plenum chamber 60 and is separated from the plenum chamber 60 by a vibrating screen 64. The vibrating screen 64 may be constructed of a sturdy, corrosion resistant material such as stainless steel. Additionally, the screen portion of the vibrating screen 64 may be replaceable to minimize downtime.

The vibrating screen 64 may be coupled to a flywheel (not shown) with an eccentric weight. The flywheel may be rotationally driven by an electric motor (not shown) or the like to induce lateral vibration of the vibrating screen 64 with a generally circular pattern. The vibrating screen 64 may have a mesh size selected to retain brine shrimp eggs, yet allow a large portion of the detritus to fall through. For example, the vibrating screen 64 may have a mesh size ranging from about 75 microns to about 200 microns. Furthermore, the vibrating screen 64 may have a mesh size ranging from about 100 microns to about 140 microns. Yet further, the vibrating screen 64 may have a mesh size of about 120 microns. Many suitable screening devices are commercially available. For example, Sweco, of Florence, Ky., manufactures a complete line of particle separation devices.

The separation chamber 62 may be coupled to the containment vessel 26 by a coupling 66. The coupling 66 may be designed to isolate the containment vessel 26 from the vibration of the vibrating screen 64. According to one embodiment, the coupling 66 is flexible, and hence, unable to transmit vibration. A discharge chute 68 may extend from the separation chamber 62, and may open to the portion of the separation chamber 62 just above the vibrating screen 64.

The discharge chute 68 may be used at the completion of processing to remove viable cysts from the containment vessel 26 and the separation chamber 62. The viable cysts may then be emptied from the discharge chute 68 into a collection container 70. The collection container 70 may be formed, for example, of a breathable, porous material with a mesh size small enough to retain the brine shrimp eggs. During processing, the discharge chute 68 may be blocked by a valve or plug (not shown).

On the other hand, detritus such as shell fragments, sand, and the like may fall through the vibrating screen 64, through the plenum chamber 60, and into a detritus chamber 72. If desired, the detritus chamber 72 may be removable so that the detritus can be easily taken and dumped at a suitable location. In the alternative, a porous bag or the like may be used to collect the detritus.

The screening device 24 may be disposed underneath a support table 74, which may be constructed of a sturdy material such as a metal. The support table 74 has an opening at the center to permit air and entrained material to move between the coupling 66 and the containment vessel 26.

The separation chamber 62 may have a test port 76 with a small, valved opening. The test port 76 may be opened at any time during processing; a small quantity of the material within the separation chamber 62 will then be driven out of the test port 76. A suitable container (not shown) may be used to capture the expelled cysts and test them for moisture content, purity, and/or microorganism contamination to determine how much additional processing is needed.

A thermostat 78 may also be coupled to the separation chamber 62 to continuously measure the temperature of the air within the separation chamber 62. As mentioned previously, it is desirable to utilize warm air during processing so that the air will absorb more moisture from the eggs. However, if the air is too hot, it will damage the eggs. The operating temperature may greatly depend upon the species of brine shrimp egg being processed.

For example, some species may be optimally processed at a temperature of about 95° Fahrenheit to ensure that the eggs are rapidly dried, yet undamaged. More sensitive species, may, however, hatch at temperatures under 95° F. Thus, it may be desirable to maintain the airflow entering the separation chamber 62 at a temperature of 80° F. or 60° F. In order to provide the lowest possible incidence of premature hatching, it may even be desirable to keep the airflow at a temperature as low as about 40° F.

The thermostat 78 may transmit signals to the furnace 22 to control the amount of heat added to the airflow by the furnace 22, thereby keeping the airflow temperature within the desired range. The furnace 22 may be simply activated or deactivated by the thermostat 78, or the furnace 22 may have multiple heating levels that can be selected by the thermostat 78.

As the apparatus 10 commences its operation on a new batch of unprocessed brine shrimp eggs, a comparatively large amount of moisture may be present. The evaporation of the moisture will cool the temperature of the airflow. As the brine shrimp eggs become dry, less evaporation will occur; therefore, the cooling effect of the evaporation on the airflow will decrease as the drying cycle progresses. Hence, it may be necessary to add a larger amount of heat to the airflow toward the commencement of the drying cycle, and then to steadily decrease the quantity of heat added to keep the temperature of the airflow within the containment vessel 26 generally consistent.

If desired, the thermostat 78 may be positioned at a variety of other locations, such as within the containment vessel 26. Multiple thermostats 78 may even be used, if desired. Alternatively, other sensor types, such as pressure, moisture, and airflow velocity sensors may be applied to indirectly monitor and/or control the processing conditions, such as the air temperature, within the containment vessel 26.

During the drying process, the brine shrimp eggs and the remaining detritus are entrained in the dry airflow, and are conveyed upward into the containment vessel 26 through the coupling 66. The vibration of the vibrating screen 64 ensures that brine shrimp eggs and detritus are unable to cake the surface of the vibrating screen 64 and block the airflow.

Additionally, the vibration helps the brine shrimp eggs to move from the vibrating screen 64 to the discharge chute 68 after processing has been completed.

The containment vessel 26 may be designed with two distinct volumes, such that the brine shrimp eggs are concentrated within a first volume and the detritus is concentrated within a second volume. Such concentration may be achieved through the use of an airflow that moves through both volumes, with a different airflow velocity in each volume. Varying airflow velocities may be obtained with a wide variety of containment vessel configurations, only one of which is shown in FIG. 1.

In the processing apparatus 10 of FIG. 1, the containment vessel 26 takes the form of a vertical column with a narrow section 80 that rests on the support table 74, a flare 82 above the narrow section 80, and a wide section 84 disposed above the flare 82. The narrow section 80 has a comparatively small cross sectional area, or area perpendicular to the direction of the airflow (i.e., horizontal area in the embodiment of FIG. 1). Similarly, the wide section 84 has a comparatively large cross sectional area.

A loading chute 86 may be attached to the narrow section 80, and may convey brine shrimp eggs and detritus into the narrow section 80 through a one way baffle 88. The one way baffle 88 may, for example, take the form of a swinging door that only swings inward; the swinging door may be spring loaded to ensure that the air moving through the narrow section 80 does not force the one way baffle 88 to open.

The geometry of the containment vessel 26 operates to maintain the viable cysts generally within the narrow section 80, and the comparatively light weight detritus within the wide section 84. More specifically, as the dry air moves through the flare 82, it expands to a larger cross sectional area. Since air is generally permitted to enter or leave the containment vessel only at the top or bottom, the mass flow rate of the air through the containment vessel 26 must remain substantially constant at each cross section along the height of the containment vessel 26 during steady state operation. Consequently, the average velocity of the airflow, or "airflow velocity," within the wide section 84 will be lower than the airflow velocity within the narrow section 80.

The lift applied by the airflow to the cysts and detritus is generally proportional to the velocity of the airflow. If the lift applied to a body is sufficient to overcome the force of gravity on the body, the body will rise. The more rapid airflow of the narrow section 80 provides enough lift to suspend the cysts, while the slower airflow of the wide section 84 is only sufficient for the comparatively light detritus. Hence, the detritus moves into the wide section 84, while the cysts generally remain within the narrow section 80. Since the cysts are not uniform in size and weight, some of the cysts may be lifted into the wide section 84 together with the detritus.

In the alternative to the containment vessel configuration of FIG. 1, any configuration that utilizes an airflow to separate the brine shrimp eggs and detritus into separate volumes may be used. For example, a containment vessel may have two volumes of equal size, in which an airflow moves through the first volume, and then to one or more vents to the containment vessel exterior. A portion of the airflow may escape through the vents while the remainder moves through the second volume. Since the mass flow rate of air that moves through the second volume is lower than the mass flow rate of air that moves through the first volume, less lift will be generated within the second volume. The vents may be screened to ensure that brine shrimp eggs are unable to escape.

Returning to the configuration of FIG. 1, a plurality of ultraviolet lights 90 may be arrayed around the interior of the narrow section 80, and oriented to project ultraviolet radiation at the mass of air and material within the narrow section 80. The ultraviolet lights 90 may be shielded from the moving air and material by transparent enclosures or the like (not shown). The circulation of the airborne eggs within the narrow section 80 may serve to ensure that ultraviolet radiation impinges comparatively uniformly against the surface of each egg, without impinging against any single surface long enough to damage the egg itself. Thus, harmful microorganisms may be exterminated with a comparatively low incidence of damage to the eggs.

Continuous motion of the brine shrimp eggs during ultraviolet exposure may be provided in other ways besides air entrainment. For example, brine shrimp eggs in a rotating drum, conveyer system, or the like may also be exposed to ultraviolet light; the motion provided by such devices may be sufficient to avoid harming the brine shrimp eggs. Hence, the invention includes devices that expose brine shrimp eggs to ultraviolet radiation through motion other than that induced by air entrainment.

The wide section 84 may be covered by a screen 92, which may have about the same mesh size as the vibrating screen 64, i.e., about 120 microns. If desired, the screen 92 may be formed of a polymeric mesh such as woven nylon. In any case, the screen 92 permits air, and possibly some fine detritus, to exit the wide section 84. Hence, outflows 94 from the screen 92 are shown by arrows. If desired, the screen 92 may have a mesh size selected to ensure that any eggs entrained in the airflow of the wide section 84 are unable to escape the containment vessel 26 through the screen 92.

A camera 96 may be disposed in the wide section 84, and may be oriented downward to view the interior of the wide section 84, the flare 82, and the narrow section 80. The camera 96 may take the form of a video camera that transmits an analog or digital video image to a display 98. The display 98 may be part of a monitoring terminal, from which an operator is able to observe the operation of the apparatus 10 and make suitable adjustments. One or more lights 100 may be disposed within the wide section 84 or outside the screen 92 to illuminate the interior of the containment vessel 26 so that the brine shrimp eggs and detritus are visible using the camera 96.

As the eggs lose moisture, they may become lighter. The camera 96 and display 98 may be used to continuously monitor the relative positions of the eggs and the detritus to ensure that the eggs remain generally concentrated within the narrow section 80, and the detritus is generally elevated into the wide section 84. The velocity of the airflow entering the narrow section 80 may be adjusted by adjusting the variable damper 48. The airflow velocity may generally be decreased as the drying cycle progresses. Additionally, the quantity and/or pressure of air drawn into the extractor 28 may be adjusted to help maintain the proper separation between the brine shrimp eggs and the detritus within the containment vessel 26.

A conduit 102 may convey air and entrained material from the wide section 84 to the extractor 28. The material entrained in the air within the conduit 102 may comprise mostly detritus, since the viable cysts are generally located within the narrow section 80, away from the inlet of the conduit 102. However, the cysts may become lighter as their moisture evaporates; hence, some viable cysts may rise into the wide section 84 and be drawn into the conduit 102.

Additionally, the quantity of viable cysts within the wide section 84 may be somewhat larger than desired due to operator error.

Thus, the extractor 28 may beneficially be configured to remove viable cysts from the air and detritus. A variable damper 110 may be coupled to the conduit 102 to control the flow rate, or airflow velocity, of air and entrained material drawn through the conduit 102. The airflow velocity may be adjusted to ensure that substantially only material from the wide section 84 is drawn into the conduit 102, while the brine shrimp eggs within the narrow section 80 remain within the containment vessel 26.

The extractor 28 may comprise any device that removes detritus from the wide section 84. Simple blower systems and the like may be used. In the embodiment of FIG. 1, the extractor 28 is also configured to reclaim brine shrimp eggs that have been elevated into the wide section 84 with the detritus. Thus, the extractor 28 includes a mechanism that further separates brine shrimp eggs from detritus. In the embodiment of FIG. 1, the separation mechanism comprises a cyclone separator. However, it is envisioned that the separation mechanism may take many forms, such as a second containment vessel (not shown) with varying cross sectional areas, like the containment vessel 26.

Returning to the configuration of FIG. 1, the extractor 28 may have a receiving chamber 112 with a generally cylindrical shape, into which the air and entrained material of the conduit 102 are drawn. A conical portion 114 may be disposed underneath the receiving chamber 112. A blower 116 may be disposed above the receiving chamber 112 to create a vacuum that draws the air and material into the conduit 102 from the wide section 84. The blower 116 may also utilize a radial fan (not shown) driven by a rotary motor (not shown), and may operate at a mass flow rate of about 2,200 cubic feet per minute. Like the blower 20, the blower 116 may utilize any combination of motors and air moving elements.

The receiving chamber 112 and the conical portion 114 cooperate to form a cyclone separator. In effect, the air circulates around the conical portion and the receiving chamber 112. If desired, the conduit 102 may connect to the receiving chamber 112 at a generally horizontal angle to enhance the circular flow of the air.

The airflow velocity and/or flow pattern may be such that heavier particles, such as viable cysts, drop from the airflow onto the surface of the conical portion, while lighter waste particles (i.e., detritus) remain entrained and are drawn through the blower 116. The geometry of the receiving chamber 112 and/or the conical portion 114 may be adjusted, or "tuned," to provide a cyclonic airflow with the proper characteristics, i.e., an airflow that retains detritus while releasing brine shrimp eggs.

The lighter waste may be conveyed through another conduit 118 to reach a collection container 120. If desired, the conduit 118 may have a screened vent (not shown) that permits air to escape. Alternatively, the collection container 120 may have a porosity selected to permit the air to escape, while the detritus is retained. Air outflows 122 from the collection container 120 are indicated by arrows. The heavier cysts drops from the conical portion 114, into another collection container 124.

The processing apparatus 10 may be embodied in many different sizes, according to the volume of material that is to be processed. The sizes and operating parameters of the components of the processing apparatus 10 may simply be scaled proportionately to maintain the proper relative airflow velocities, temperatures, and pressures.

In the exemplary embodiment, the support table 74 may be about ten feet high. The narrow section 80 may be about twelve feet high, and about four feet in diameter. The flare 82 may be about eight feet high, and may flare to a diameter of about eight feet. The wide section 84 may be about five feet high, and may have a diameter of about eight feet. Hence, the total height of the processing apparatus 10 may be about thirty-five feet.

The relative heights and diameters of the narrow section 80, the flare 82, and the wide section 84 may be maintained in approximate proportion to create a processing apparatus with any desired size. The scaled processing apparatus will simply have a containment vessel shaped in a manner similar to that of the containment vessel 26 of FIG. 1. When the wide section 84 has a diameter of about double that of the narrow section 80, the beneficial egg and detritus separation properties of the containment vessel 26 may be obtained.

With such a configuration, the airflow velocity within the narrow section 80 may be about quadruple that of the wide section 84. Although other airflow velocity ratios may be operable to obtain the desired separation between brine shrimp eggs and detritus, the four-to-one ratio of the exemplary apparatus 10 of FIG. 1 has been found to be beneficial.

As mentioned before, the blower 20 may convey air at a flow rate of about 4,500 cubic feet per minute, and the blower 116 may convey air at a flow rate of about half that of the blower 20, or about 2,200 cubic feet per minute. The furnace 22 may also have a given heat rating, or Btu rating, which may be discerned by those of skill in the art based on factors such as the mass flow rate of the airflow, the ambient temperature during processing, and the necessary reduction in relative humidity of the airflow. Such parameters may also be scaled to match the size of the scaled containment vessel. Airflow and heat parameters may, however, be scaled in proportion to the square of the linear dimensions of the new containment vessel, since the cross sectional area of the containment vessel is proportional to the square of its diameter.

The processing apparatus 10 may operate in a batch mode. More specifically, the blowers 20, 116, the vibrating screen 64, and the furnace 22 may first be activated, with the variable dampers 48 and 110 and the furnace 22 set at initial airflow and heating rates. A specified weight of brine shrimp and extraneous material may be loaded into the loading chute 86. If desired, some of the detritus may be removed from the brine shrimp eggs prior to entry into the containment vessel 26. For example, a settling tank, screen system, washing system, or the like may be used to remove larger, and possibly some smaller, detritus from the brine shrimp eggs in advance of the drying process.

After loading, the brine shrimp eggs and detritus may drop toward the vibrating screen 64. Some of the material may be immediately entrained and suspended in the airflow, while other material, particularly clumps, may fall to land against the vibrating screen 64. Clumps are shaken loose by the vibrating screen 64, and small bits of detritus are permitted to fall through the vibrating screen 64 and into the detritus chamber 72. Brine shrimp eggs and detritus that did not fall through the vibrating screen 64 is then entrained in the airflow and lifted into the narrow section 80. The lightweight detritus is further lifted to the wide section 84.

In the narrow section 80, the viable cysts are individually suspended in the airflow. Since the viable cysts are not clumped or piled, as in many known brine shrimp processing systems, the dry air is able to circulate around each individual cyst to effectuate rapid and gentle drying. It is anticipated that the apparatus 10 of the present invention may require on the order of three hours to dry a batch of brine shrimp to the desired 7.5% internal moisture level. This represents a marked improvement over tumble dryers and the like, which may require about seven or eight hours to dry each batch.

During the drying process, the cysts within the narrow section 80 may also be disinfected by the ultraviolet lights 90. The cysts are in constant motion and are separate from each other; consequently, the surface of each cyst will be relatively evenly and completely bathed in ultraviolet light.

During drying, the extractor 28 operates to remove and sort detritus and/or eggs from the wide section 84. The operator may watch the display 98 to determine the amount of detritus present, and may adjust the variable damper 110 accordingly. Additionally, the operator may adjust the variable damper 48 and the furnace 22 to keep the brine shrimp eggs optimally positioned within the narrow section 80 and to keep the air at the desired temperature and relative humidity. As the eggs lose moisture, they will become lighter; hence, it is anticipated that the variable dampers 110, 48 and the furnace 22 will have to be periodically adjusted. More precisely, the airflow velocity produced by the blower 20 and the heat added by the furnace 22 may have to be steadily decreased during the drying process.

If desired, the variable dampers 110, 48 and the furnace 22 may be controlled through the use of mechanical or electrical controls. Such controls may be disposed on the dampers 110, 48 and the furnace 22, or may be remotely located to enable the operator to make necessary changes without leaving the screen 98.

If desired, control of the processing apparatus 10 may even be automated through the use of a computerized control system or the like. For example, the camera 96 and/or other sensors may be used to measure properties of the airflow within the containment vessel 26, such as temperature, humidity, pressure, and the like. The control system may then automatically adjust the dampers 110, 48 and the furnace 22 according to the output of the camera 96 and/or sensors. Depending on the amount of material to be processed, the use of a human operator may or may not be more economical.

Once drying, disinfecting, and cleansing have been completed, the blowers 20, 116 and the furnace 22 may be deactivated to permit the eggs to fall to the vibrating screen 64. The vibrating screen 64 may remain operational to shake the eggs toward the discharge chute 68. The discharge chute 68 may be unplugged, and the eggs may be emptied into the collection container 70. The collection containers 70, 124 may be prepared for shipping to the customer, and the detritus chamber 72 and the collection container 120 may be emptied at a suitable waste repository. The vibrating screen 64 may then be deactivated and the screen portion may be removed for cleaning or replacement so that the next batch can be processed.

The brine shrimp egg processing apparatus and method of the present invention provides several advantages over prior art systems. Through the use of air suspension, the brine shrimp eggs may be dried rapidly and effectively to maintain high viability. Screening may be used to separate the eggs from detritus based on relative size, and airflow velocity variation provides separation based on relative density and surface characteristics. Hence, the brine shrimp egg processing apparatus and method of the present invention provide relatively complete separation of viable cysts from extraneous material. Furthermore, the cysts can be safely and uniformly disinfected through the use of ultraviolet radiation.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A containment vessel for a processing apparatus for separating brine shrimp eggs from detritus, the containment vessel comprising:

a narrow section configured to receive an airflow having a first airflow velocity within the narrow section, wherein the first airflow velocity is selected to substantially entrain the brine shrimp and detritus in the airflow within the narrow section; and a wide section configured to receive the airflow from the narrow section, the airflow having a second airflow velocity within the wide section, wherein the second airflow velocity is lower than the first airflow velocity so that the brine shrimp eggs remain substantially within the narrow section while the detritus remains entrained in the airflow within the wide section.

2. The containment vessel of claim 1, wherein the wide section is disposed above the narrow section so that the containment vessel comprises a generally vertical column, the wide section having a cross sectional area larger than a cross sectional area of the narrow section to induce the second airflow velocity to be lower than the first airflow velocity.

3. The containment vessel of claim 2, further comprising a flared section disposed between the narrow section and the wide section to conduct the airflow from the narrow section to the wide section.

4. The containment vessel of claim 2, further comprising a loading chute that extends from the narrow section to facilitate loading of brine shrimp eggs into the narrow section.

5. The containment vessel of claim 1, further comprising a video camera positioned to receive an image of an interior of the containment vessel to facilitate remote monitoring of the brine shrimp and detritus within the containment vessel.

6. The containment vessel of claim 1, further comprising at least one ultraviolet light positioned to generate ultraviolet radiation that impinges against the brine shrimp eggs to kill microorganisms on the surfaces of the brine shrimp eggs.

7. A disinfecting apparatus for disinfecting brine shrimp eggs, the apparatus comprising:

a containment vessel configured to induce substantially continuous motion of the brine shrimp eggs, wherein the containment vessel comprises a generally vertical column with a narrow section and a wide section disposed above the narrow section, the wide section having a cross sectional area larger than a cross sectional area of the narrow section so that the brine shrimp eggs are generally concentrated within the narrow section while detritus is generally concentrated within the wide section; and an ultraviolet light positioned to generate ultraviolet radiation that impinges against the moving brine shrimp eggs to kill microorganisms on the surfaces of the brine shrimp eggs.

8. The disinfecting apparatus of claim 7, wherein the containment vessel is configured to induce substantially continuous motion of the brine shrimp eggs by entraining the brine shrimp eggs in an airflow passing through the containment vessel.

9. The disinfecting apparatus of claim 7, wherein the ultraviolet light is disposed in the narrow section so that the ultraviolet radiation impinges against the brine shrimp eggs within the narrow section.

10. A method for separating brine shrimp eggs from detritus, the method comprising:

entraining the brine shrimp eggs and detritus within an airflow;

inducing passage of the airflow through a first volume at a airflow velocity selected to keep the brine shrimp eggs and detritus entrained within the airflow; and inducing passage of the airflow through a second volume at a airflow velocity selected to keep the detritus entrained within the airflow while releasing the brine shrimp eggs from the airflow, thereby concentrating brine shrimp eggs within the first volume and concentrating detritus within the second volume.

11. The method of claim 10, wherein inducing passage of the airflow through the second volume comprises inducing passage of the airflow through a cross sectional area of the second volume that is larger than a cross sectional area of the first volume, the larger cross sectional area of the second volume inducing the airflow velocity of the airflow to be lower within the second volume than within the first volume.

12. The method of claim 11, further comprising inducing passage of the airflow through a third volume between the first and second volumes, the third volume having an expanding cross sectional area to permit reduction of the airflow velocity as the airflow passes through the third volume.

13. The method of claim 10, further comprising drawing at least a portion of the airflow from the second volume into a cyclone separator.

14. The method of claim 13, further comprising inducing cyclonic motion of the portion of the airflow such that the portion of the airflow within the cyclone separator has an airflow velocity selected to retain detritus while releasing brine shrimp eggs.

15. A method for disinfecting brine shrimp eggs, the method comprising:

inducing continuous motion of the brine shrimp eggs, wherein inducing continuous motion of the brine shrimp eggs comprises entraining the brine shrimp eggs in an airflow within a containment vessel, and wherein the containment vessel comprises a generally vertical column with a narrow section and a wide section disposed above the narrow section, the wide section having a cross sectional area larger than a cross sectional area of the narrow section, wherein inducing continuous motion of the brine shrimp eggs further comprises generally concentrating the brine shrimp eggs within the narrow section and while generally concentrating detritus within the wide section; and directing ultraviolet radiation to impinge against the moving brine shrimp eggs to kill microorganisms on the surfaces of the brine shrimp eggs.

16. The method of claim 15, wherein directing ultraviolet radiation to impinge against the moving brine shrimp eggs comprises activating ultraviolet lights disposed within the narrow section of the containment vessel so that the ultraviolet radiation is directed primarily toward the brine shrimp eggs concentrated within the narrow section.

* * * * *